US009834893B2

(12) United States Patent
Lynch

(10) Patent No.: US 9,834,893 B2
(45) Date of Patent: Dec. 5, 2017

(54) PAVER LOCK DOWN SYSTEM AND METHODS

(71) Applicant: Bret Lynch, Snow Camp, NC (US)

(72) Inventor: Bret Lynch, Snow Camp, NC (US)

( * ) Notice: Subject to any disclaimer, the term of this patent is extended or adjusted under 35 U.S.C. 154(b) by 0 days.

(21) Appl. No.: 15/272,737

(22) Filed: Sep. 22, 2016

(65) Prior Publication Data

US 2017/0081803 A1 Mar. 23, 2017

Related U.S. Application Data

(60) Provisional application No. 62/222,263, filed on Sep. 23, 2015.

(51) Int. Cl.
*E01C 5/00* (2006.01)
*E01C 19/52* (2006.01)

(52) U.S. Cl.
CPC ..... *E01C 5/006* (2013.01); *E01C 19/52* (2013.01)

(58) Field of Classification Search
CPC ..... E01C 5/006; E01C 19/52
USPC ..... 404/18, 31, 34, 36, 73, 40
See application file for complete search history.

(56) References Cited

U.S. PATENT DOCUMENTS 5,342,141 A * 8/1994 Close ..... E01C 5/001 404/28
5,890,836 A * 4/1999 Leech ..... E02L 33/14 404/34
6,171,015 B1 * 1/2001 Barth ..... E01C 5/001 404/34
7,344,334 B2 * 3/2008 Thorkelson ..... E01C 5/18 404/28
8,696,234 B2 * 4/2014 Smith ..... E01C 5/001 404/29
8,881,482 B2 * 11/2014 Cerny ..... E04F 15/02038 52/126.5
9,725,899 B2 * 8/2017 Huckey ..... E04L 35/02

* cited by examiner

*Primary Examiner* — Raymond W Addie
(74) *Attorney, Agent, or Firm* — Ward and Smith, P.A.; Ryan K. Simmons

(57) ABSTRACT

A paver locking system. The paver locking system may include; a paver assembly, including a paver; and straps attached to a back portion of the paver. The paver locking system may further include a paver spacer; and a securing mechanism for securing paver straps to the paver spacer.

20 Claims, 13 Drawing Sheets

PAVER LOCK DOWN SYSTEM AND METHODS

1 RELATED APPLICATIONS

This application is related to and claims priority to U.S. Provisional Patent Application No. 62/222,263, filed on Sep. 23, 2015, entitled "Porcelain Paver Lock Down System and Methods", the entire disclosure of which is incorporated herein by reference.

2 FIELD OF THE INVENTION

This invention pertains generally to architectural pavers and more particularly to a paver hidden lock down system and methods.

3 BACKGROUND OF THE INVENTION

Paver tiles, for example, porcelain tiles, have many benefits as a finish material. The dense, fully vitrified body of the product makes it easy to clean and resists surface wear. For this reason porcelain tile is the top choice for owners and specifiers looking to clad high traffic interior and exterior floors in tile. Traditional method of porcelain tile installation is to glue the product down to a substrate. This standard thickness (9-12 mm thick) porcelain tile alone has very poor center load and tensile strength when not fully bonded to a suitable substrate.

Currently, the plaza deck, rooftop, and landscape paver market is dominated by 2-inch thick pressed concrete architectural pavers. These pavers are considered to be self-supporting and have about 2 to 3 inches of support by the pedestals (only under the corners) at the paver intersections. Thinner and lighter pavers can solve a great deal of problems associated with load on the structures and shallow deck profiles. Therefore, porcelain tile manufacturers have been working to enter this market. A recent trend in the tile industry is for many manufacturers to produce "extra thick" 20 mm (2 cm thick) (less than half the thickness of the concrete pavers) porcelain tiles that allegedly can be used without bonding to a substrate, so they are considered a "self-supporting" porcelain paver that can be supported in a similar manner as the 2-inch thick concrete paver. While the added thickness does provide some level of improved tensile strength, shock impact and very heavy loads may cause these "extra thick" pavers to shatter just like the traditional thinner tiles.

Even the proven industry accepted 2-inch thick concrete pavers break occasionally. Likewise, the porcelain pavers break occasionally. When concrete pavers break on pedestals they merely crack into large pieces. Once broken, the concrete pavers buckle and fall off the pedestal supports. The broken edges may be serrated but are rather dull and will not seriously slice the skin. That is, the broken concrete pavers pose little risk of injury. By contrast, when a porcelain paver breaks it shatters like non-tempered glass. Razor sharp edges and large daggers and shards are created, which can easily cut the skin and are dangerous.

4 BRIEF DESCRIPTION OF THE INVENTION

In one embodiment, the invention provides a paver locking system. The paver locking system may include a paver assembly, including a paver; and straps attached to a back portion of the paver. The paver locking system may further include a paver spacer; and a securing mechanism for securing paver straps to the paver spacer. The straps attached to the back portion of the paver may include a first strap and a second strap configured to form an X pattern on the back portion of the paver, wherein the first strap is arranged across a first diagonal and the second strap is arranged across a second diagonal of the back portion of the paver. Each of the first strap and second strap may be of a length such that each end of each of the first strap and second strap extend beyond its associated corner of the paver. The ends of the first strap and second strap extend about ⅝ of an inch beyond its associated corner of the paver. The paver locking system may further include a bonding layer disposed on the back portion of the paver and configured for securing the straps to the back portion of the paver, wherein the straps may be secured between the bonding layer and back portion of the paver. The bonding layer may include one of epoxy resin, fiberglass resin, or polyester resin. The bonding layer may include a fiber mesh and an epoxy resin. The bonding layer may cover substantially an entirety of the back portion of the paver. The paver may include a porcelain paver about 2 cm thick. The paver may include one or more of ceramic, concrete, natural stone (e.g., granite and/or slate), and/or any other self supporting paver. The straps may further include a hole provided in each end of the straps. The paver spacer may include a baseplate; and tabs protruding upward from a first surface of the base plate. The tabs may be configured for one or more of setting corners of the paver in relation to another paver, to set the spacing between adjacent pavers, and to guide the straps onto the paver spacer. The tabs may include four tabs equally spaced about the base plate. The securing mechanism for securing the paver straps to the paver spacer may include one or more of, or combinations of a screw, bolt, and nut. The paver spacer may further include a recessed region formed in a central portion of the first surface of the paver spacer.

In another embodiment, the invention provides a paver spacer. The paver spacer may include a baseplate; a recessed central portion in a first surface of the baseplate; and tabs protruding upward from the first surface of the base plate and spaced equally about the recessed central portion.

In yet another embodiment, the invention provides a paver assembly. The paver assembly may include a paver; and straps attached to a back portion of the paver, wherein the straps comprise a first strap and a second strap configured to form an X pattern on the back portion of the paver, and wherein the first strap is arranged across a first diagonal and the second strap is arranged across a second diagonal of the back portion of the paver.

In still yet another embodiment, the invention provides a method of forming a paver assembly. The method may include providing a paver; removing an amount of paver material from an underside surface of each corner of the paver to form a notch at each corner of the paver; installing a first strap and a second strap to the underside surface of the paver in an X pattern, wherein the first strap is arranged across a first diagonal and the second strap is arranged across a second diagonal of the underside surface of the paver; and applying a bonding layer to the underside surface of the paver, wherein the first strap and second strap are disposed between the bonding layer and the underside surface of the paver. The bonding layer may include a fiber mesh.

In still yet another embodiment, the invention provides a method of installing a paver locking system. The method may include providing a first paver assembly and a paver spacer, wherein the first paver assembly may include a first paver; and straps attached to a back portion of the first paver, wherein the straps are configured in an X pattern and comprise a portion that extends beyond one or more of corners of the first paver. The method may further include aligning the paver spacer with at least one of the straps of the first paver at a respective corner of the first paver, wherein a portion of at least one of the straps of the first paver assembly overlaps a central portion of the paver spacer; providing a second paver assembly adjacent to the first paver assembly, wherein the second paver assembly may include a second paver; and straps attached to a back portion of the second paver, wherein the straps are configured in an X pattern and comprise a portion that extends beyond one or more corners of the second paver. The method may further include aligning at least one of the straps of the second paver assembly with the paver spacer, such that it overlaps with a portion of the at least one of the straps of the first paver assembly at a central portion of the paver spacer; and securing the aligned at least one strap of the first paver and at least one strap of the second paver to the paver spacer at a central portion of the paver spacer where the at least one strap of the first paver and second paver overlap.

These and other embodiments will be apparent from the ensuing specification.

5 BRIEF DESCRIPTION OF THE DRAWINGS

Having thus described the presently disclosed subject matter in general terms, reference will now be made to the accompanying Drawings, which are not necessarily drawn to scale, and wherein:

Figure 6A:
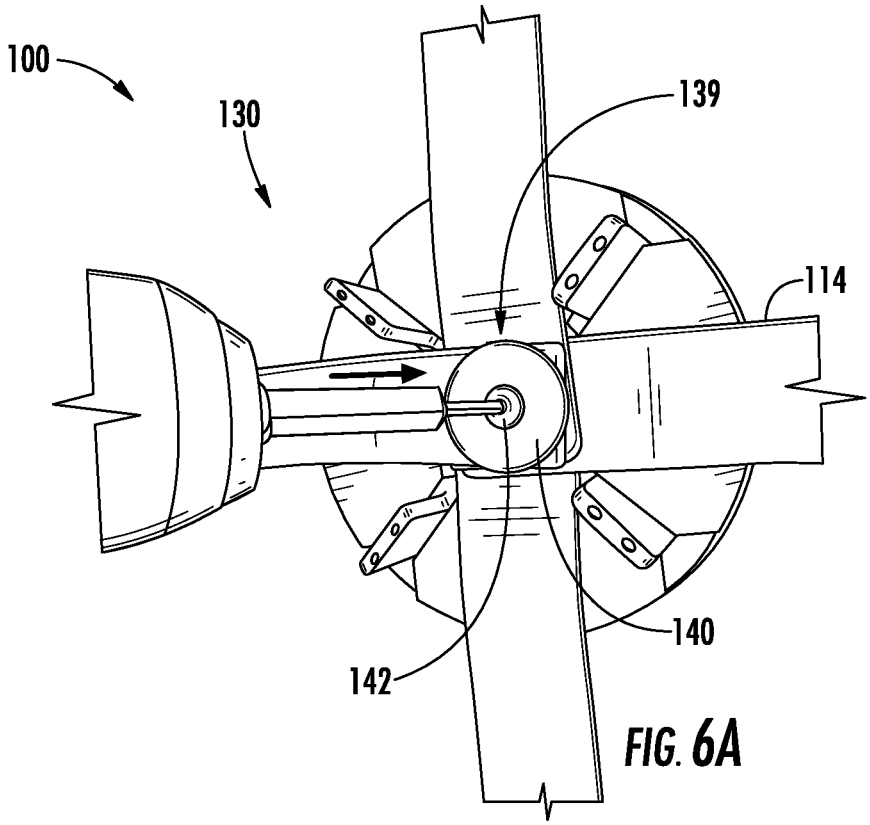
Figure 6B:
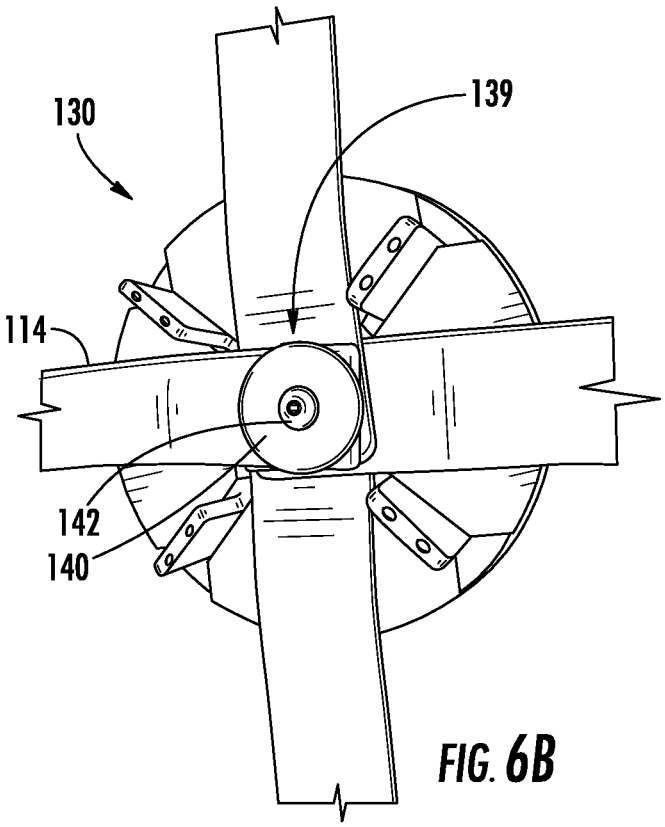
Figure 7:
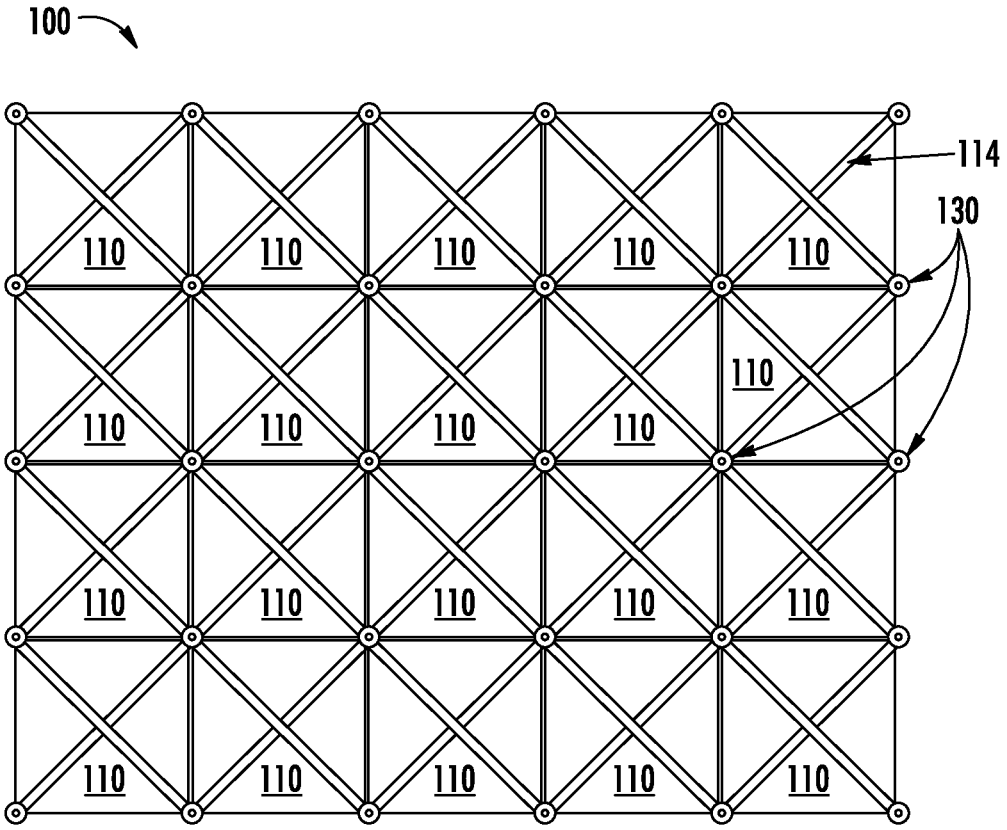
Figure 8:
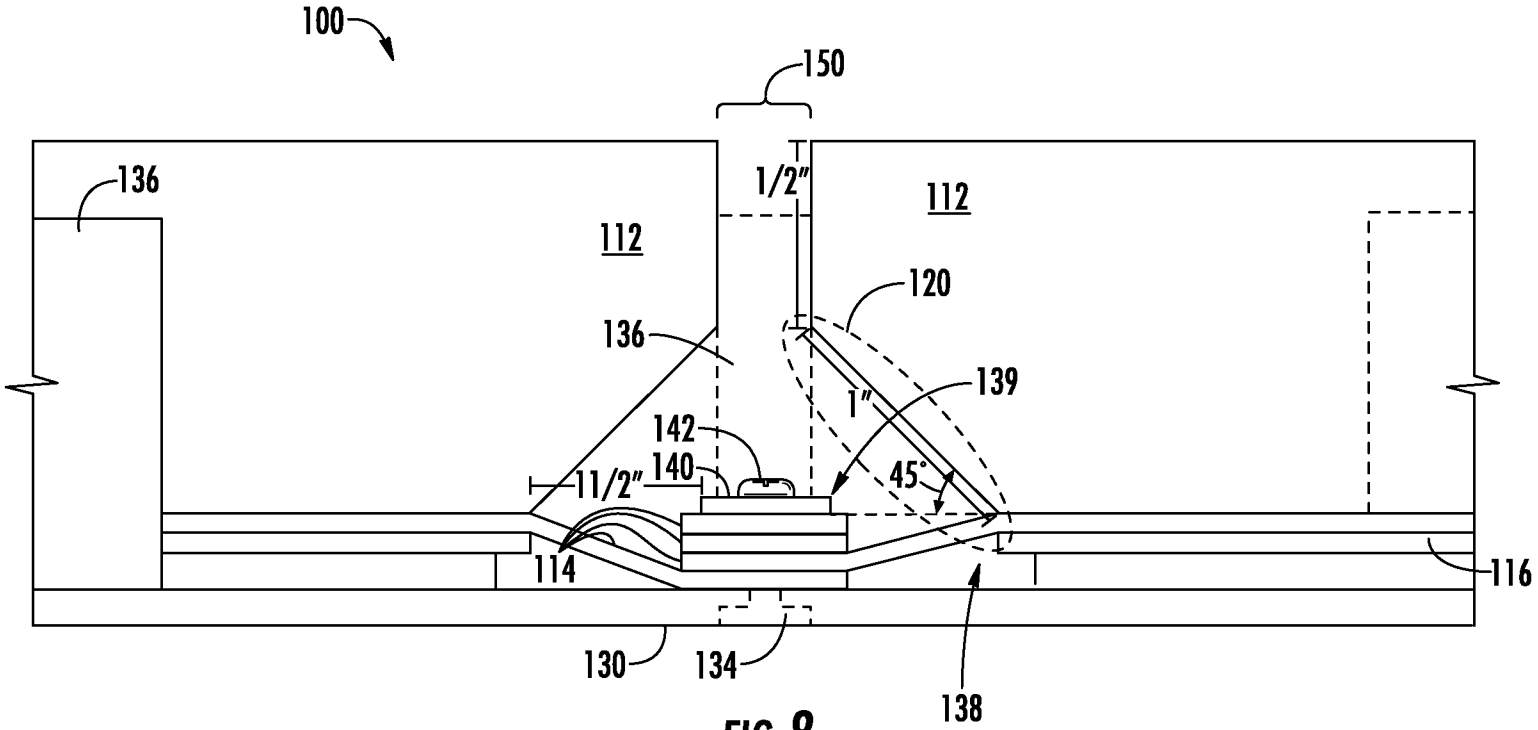
Figure 9:
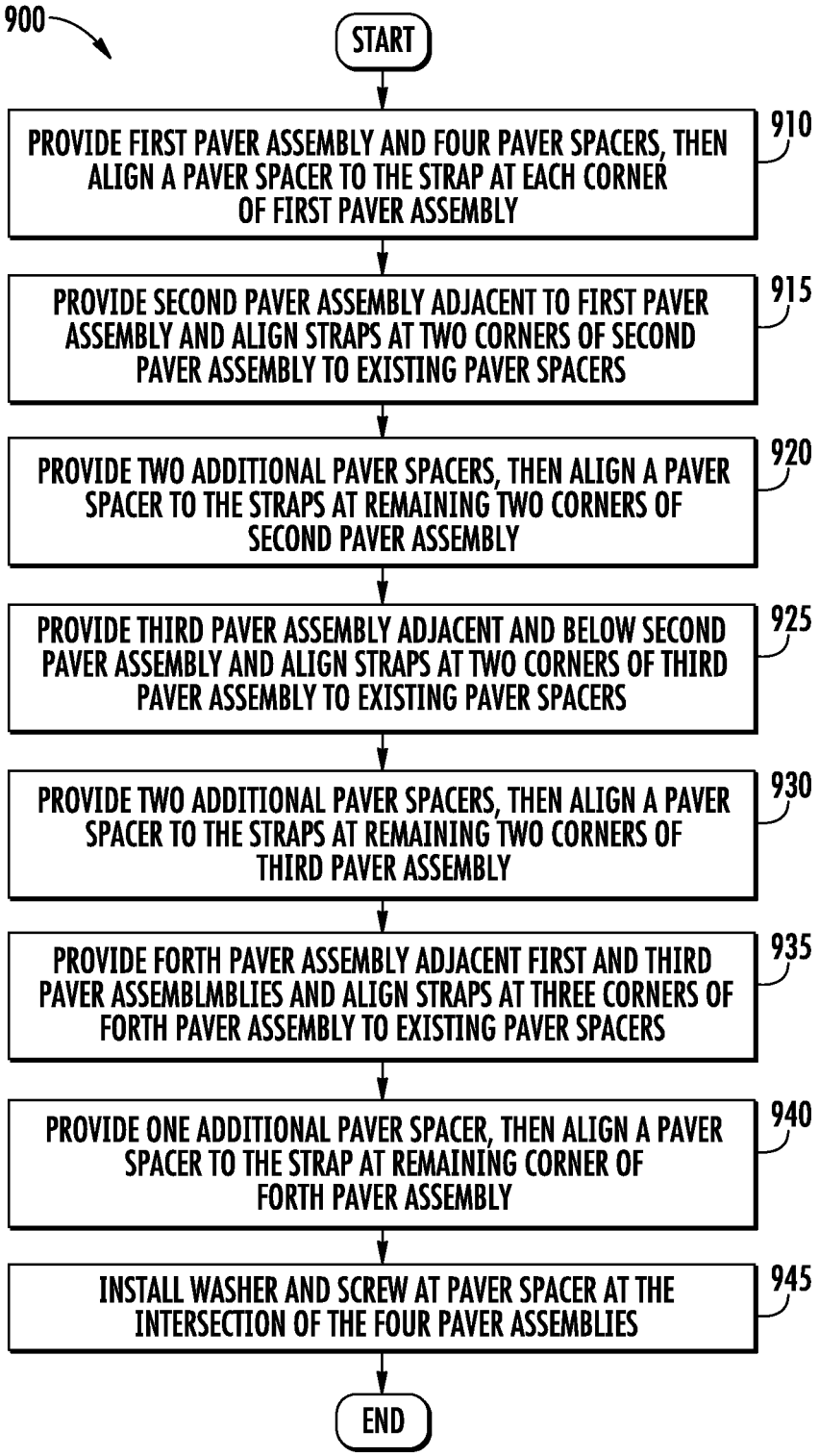
Figure 10:
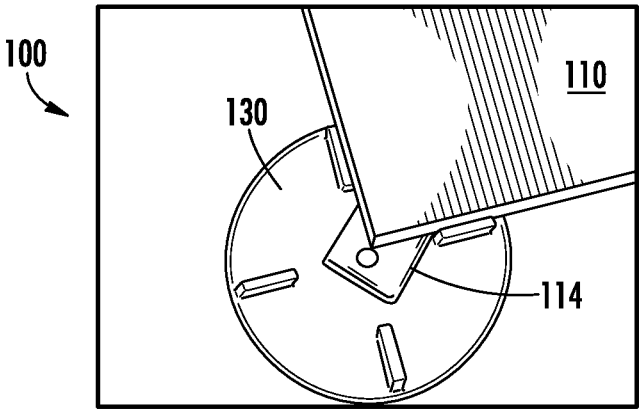
Figure 11:
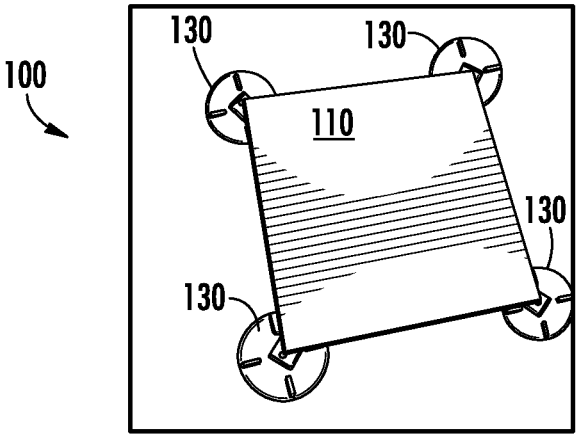
Figure 12:
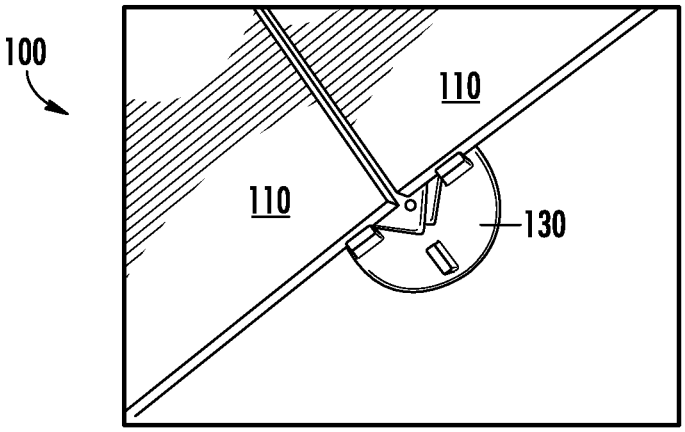
Figure 13:
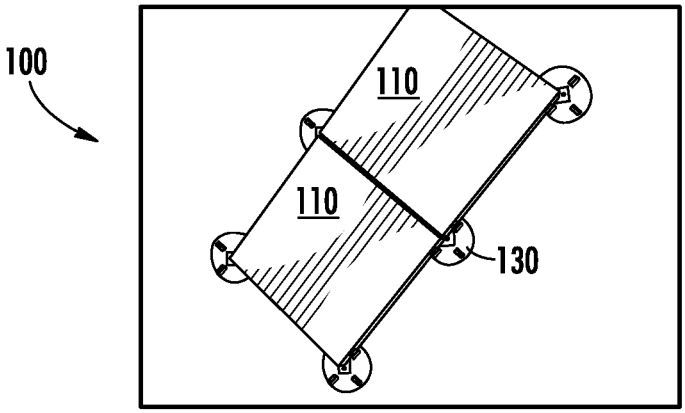
Figure 14:
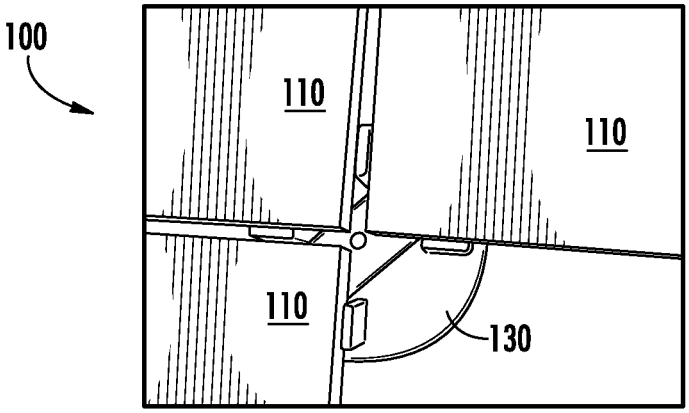
Figure 15:
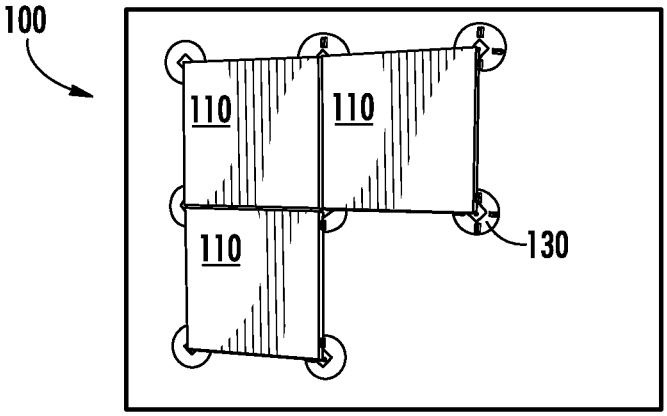

FIG. 5A, FIG. 5B, FIG. 5C, and FIG. 5D illustrate top views of the paver spacer and a process of mating straps thereto;

FIG. 6A and FIG. 6B illustrate top views of the paver spacer and a process of connecting the straps thereto;

FIG. 7 illustrates a plan view of an array of pavers of the paver lock down system, wherein the pavers are connected together forming a safety net;

FIG. 8 illustrates a cross-sectional view of the joint between pavers of the presently disclosed paver lock down system;

FIG. 9 illustrates a flow diagram of an example of a method of installing the presently disclosed paver lock down system; and FIG. 10 through FIG. 24 illustrate the steps of the method shown in FIG. 9.

6 DETAILED DESCRIPTION OF THE INVENTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof.

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The presently disclosed subject matter provides a composite, reinforced backing system to a paver, such as, for example, a porcelain paver. This backing provides strength, prevents broken tile from shattering/splintering and allows for a paver system to be connected together and thus prevents, as one advantage, vandalism (picking up and throwing of tiles) a common concern for commercial project specifiers.

The lock down system is a hidden lock down or tied down paver system. Paver intersections offer a unique locking mechanism that is hidden below the paver surface and accessed through the open joint that is created in all raised pedestal/floating paver systems. This feature prevents vandalism or tampering with the individual pavers. Porcelain pavers, for example, are very light (thus subject to being tampered with) compared to traditional 2" thick concrete pavers typically used for pedestal systems. The locking feature also prevents the floating paver system from "creeping" or "migrating" across the edges of the installation. Wind uplift is another concern for specifiers in high wind zones (e.g., coastal areas and areas subject to tornados) and for urban installations above 5-6 stories high. The lock down system may potentially provide some element of wind uplift protection due to the pavers being tied together creating a "raft" of single pavers.

In some embodiments, the presently disclosed subject matter provides a paver hidden lock down system and methods. The presently disclosed paver lock down system and methods provide a paver safety net and tie down system. Namely, the paver lock down system provides a composite, reinforced backing system to a paver, such as, any standard 2-cm thick (or any other thickness) porcelain paver (any manufacturer), or any one or more of ceramic, concrete, natural stone (e.g., granite and/or slate), and/or any other self supporting paver. This reinforced backing system provides strength and allows for the paver system to be connected together. Because the pavers of the paver lock down system are connected together, vandalism of the tiles (picking up and throwing of tiles), which is a common concern for commercial project specifiers, can be prevented. Further, whereas conventional pavers, such as porcelain pavers, shatter when they break, which can create sharp edges and large daggers and shards, the presently disclosed paver lock down system prevents broken tile from shattering/splintering. By substantially reducing or entirely eliminating the risk of injury, product specifiers and end users will be more comfortable using pavers within the presently disclosed paver lock down system for their decks, balconies, roof top plazas, etc.

Figure 1:
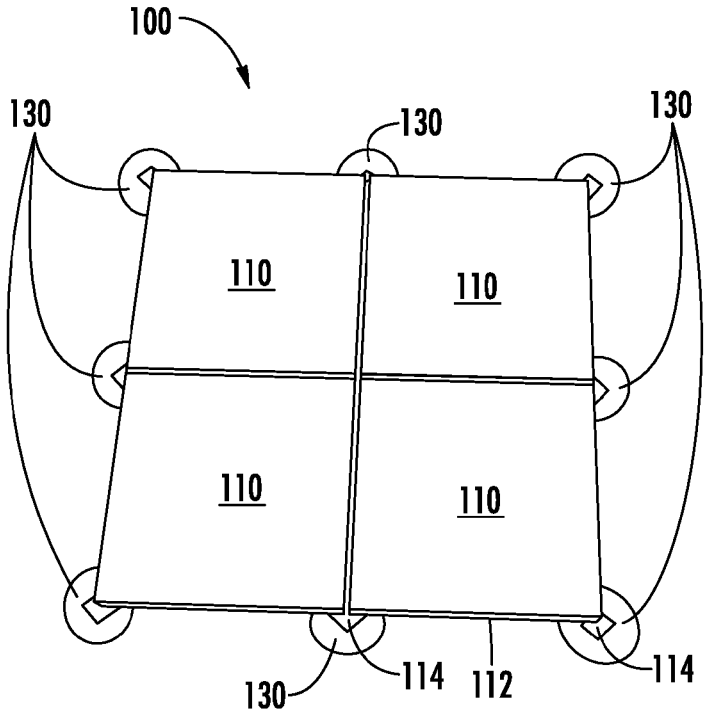
FIG. 1 illustrates a top down view of an example of the presently disclosed paver lock down system.
Figure 2:
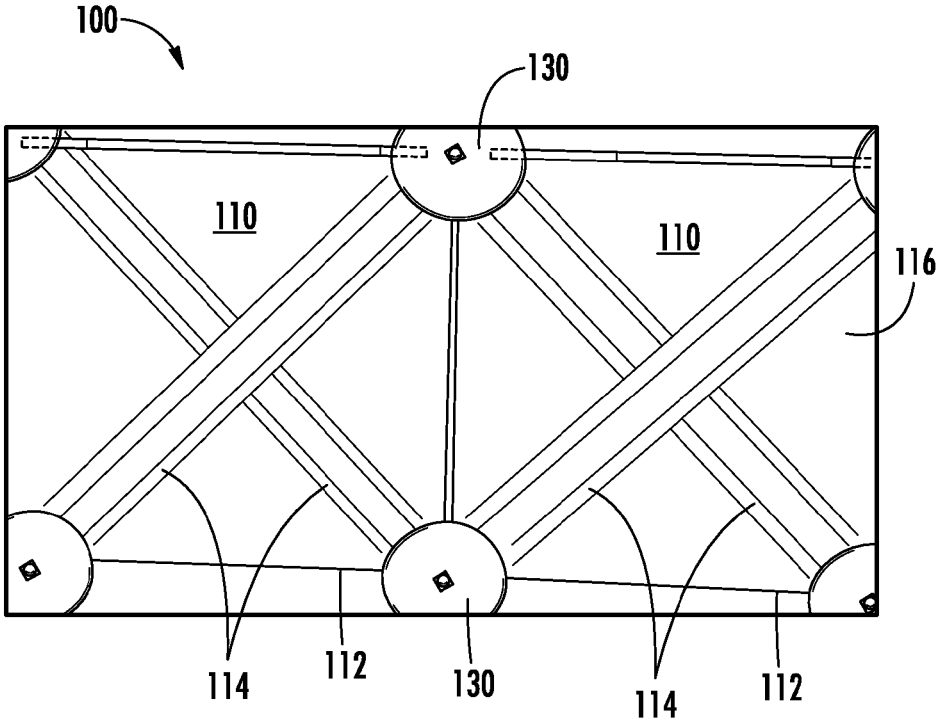
FIG. 2 illustrates an underside view of an example of the paver lock down system.

Referring now to FIG. 1 and FIG. 2 is a top down view and an underside view, respectively, of an example of the presently disclosed paver lock down system 100. The paver lock down system 100 includes an arrangement or array of paver assemblies 110 that are coupled or tied together at each corner by a paver spacer 130. In one example, each of the paver assemblies 110 includes a paver 112, for example, a standard 2-cm thick porcelain paver. On the back of the paver 112, a first strap 114 is arranged across one diagonal and a second strap 114 is arranged across the other diagonal of the paver 112. Then, a bonding layer 116, such as a fiber mesh and a resin, covers both the first and second straps 114 and preferably the exposed portions of the back of the paver 112. The bonding layer may be of any suitable materials, for example a fiber mesh and an epoxy resin. Other materials, such as fiberglass mesh or mating (and the like), and other resigns, such as fiberglass resin, polyester resin, adhesives, and the like, and/or combination of materials, capable of securing first and second straps 114 to the back of the paver 112 may be used as bonding layer 116.

More particularly, the first and second straps 114 preferably form an X pattern on the back of the back of the paver 112. In one example, the first and second straps 114 are about 1-inch wide nylon straps. The length is cut such that the ends of the straps 114 extend beyond the corners of the paver 112. In one example, the ends of the straps 114 extend in the range of about ⅝ of an inch beyond the corners of the paver 112. The bonding layer 116 is sized to substantially match the size of a backside of the paver 112. The straps 114 are preferably first placed on the back of the paver 112, followed by the bonding layer 116.

In one example, the straps 114 and the bonding layer 116 are applied to the back of the paver 112 via a layer of highly viscous resin, or other suitable adherent, coating, or the like. A hole 118 may be provided in each end of the straps 114, as shown in FIG. 5A, FIG. 5B, FIG. 5C, and FIG. 5D. More details of a non-limiting example of a method of making the paver assemblies 110 are described hereinbelow with reference to FIG. 3. The straps 114 are used to fasten the paver assemblies 110 to the paver spacers 130 and thereby form the presently disclosed paver lock down system 100. More details of an example of a method of installing the presently disclosed paver lock down system 100 are described hereinbelow with reference to FIG. 9.

Figure 3:
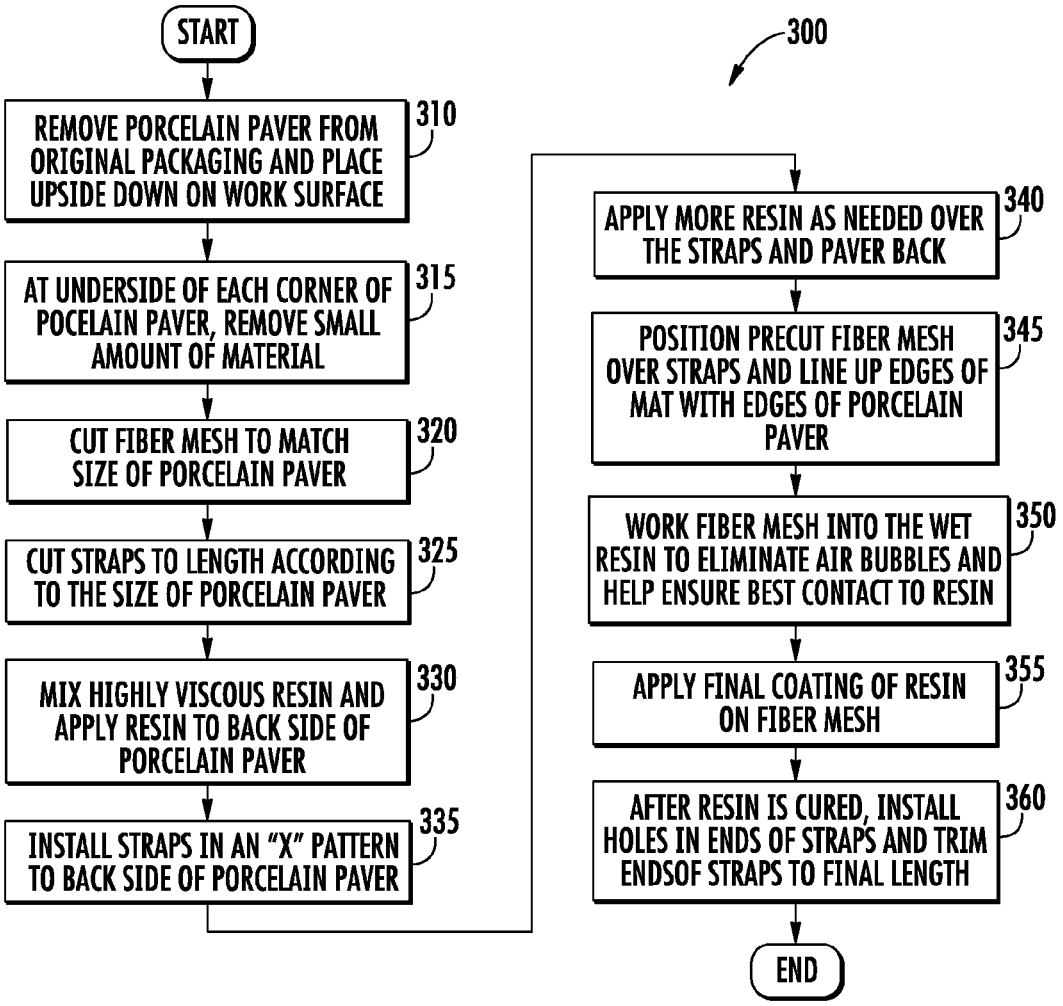
FIG. 3 illustrates a flow diagram of an example of a method of forming the paver assemblies of the presently disclosed paver lock down system.

Referring now to FIG. 3 is a flow diagram of an example of a method 300 of forming the paver assembly 110 of the presently disclosed paver lock down system 100. The method 300 may include, but is not limited to, the following steps.

At a step 310, the paver 112, in its original packaging, may be removed from the original packaging and placed upside down on a work surface.

At a step 315, at the underside of each corner of the paver 112, a notch 120 is created by removing a small amount of material, at the tip of the corner of paver 112, for example using an angle grind to create a bevel, which creates an isosceles triangle of removed material. In one example, the notch 120 has a beveled angle of about 45 degrees from horizontal and is about 1 inch in length until flush with the back of paver 112. The base of the removed material from paver 112 may be about 1½ inches wide. In one example, about ½ inch of thickness of paver 112 remains between its top surface and the upper portion of the start of the beveled angle. This notch 120 allows for the locking mechanism to work, while still allowing the pavers 112 to lay flat. The above dimensions, measurements, and/or angles may vary +/− depending on the exact dimensions of the paver(s).

At a step 320, if fiber mesh is used as part of the bonding layer 116, then the fiber mesh is cut to substantially match the size of the paver 112. In one example, if the paver 112 is 12 inches×12 inches (actually 11¾"×11¾") then the fiber mesh is cut to 12 inches×12 inches.

At a step 325, the straps 114 are cut to length according to the size of the paver 112. In one example, if the paver 112 is 12 inches×12 inches (actually 11¾"×11¾") then the straps 114 are cut to about 17½ inches in length. In another example, if the paver 112 is 24 inches×24 inches (actually 23½"×23½") then the straps 114 are cut to about 34½ inches in length. In one example, the straps 114 are 1-inch wide nylon straps. It should be appreciated that the actual lengths the straps 114 are cut to may vary due to the actual sizing of the pavers varying greatly between manufacturers.

At a step 330, a highly viscous resin, e.g., epoxy resin, (or other suitable adherent, coating, or the like), is mixed and then applied to the back side of the paver 112. For example, a highly viscous resin is mixed and then placed in a small paint roller pan. Then, a roller (e.g. 4 inch roller) may be used to "paint" the resin onto the back of the paver 112. In such an example, the entire back of the paver 112 is coated with the resin to a thickness of about 10 millimeters.

At a step 335, while the resin is still wet, the straps 114 (e.g., 1-inch wide nylon straps) may be installed in an X pattern on the back of the paver 112, wherein the ends of the straps 114 extend beyond the corners of the paver 112.

At a step 340, more resin may be applied as needed over the straps 114 and over the back of the paver 112.

At a step 345, while the resin is still wet, the fiber mesh of bonding layer 116 is positioned over the straps 114 onto the back of the paver 112, wherein the edges of the precut fiber mesh substantially align with the edges of the paver 112.

At a step 350, the fiber mesh is worked into the wet resin to eliminate air bubbles and help ensure best contact to the resin. For example, using a large flat putty knife, the fiber mesh can be worked like wallpaper into the wet resin to eliminate air bubbles and help ensure best contact to the resin.

At a step 355, a final coating of resin can be applied over the entirety of the fiber mesh to complete the bonding layer 116. For example, a 4-inch roller can be used to apply the final coating of resin to the fiber mesh (see FIG. 2).

At a step 360, after the resin is cured, the ends of the straps 114 can be trimmed to their final length if needed and holes 118 may be formed in the ends of the straps 114. Alternatively, straps 114 may be pre-cut and the holes may be pre-formed. In one example, the holes 118 are about ⅛ of an inch in diameter (see FIG. 5A, FIG. 5B, FIG. 5C, and FIG. 5D). In one example, the ends of the straps 114 may extend in the range of about ⅝ of an inch beyond the corners of the paver 112.

Figure 4A:
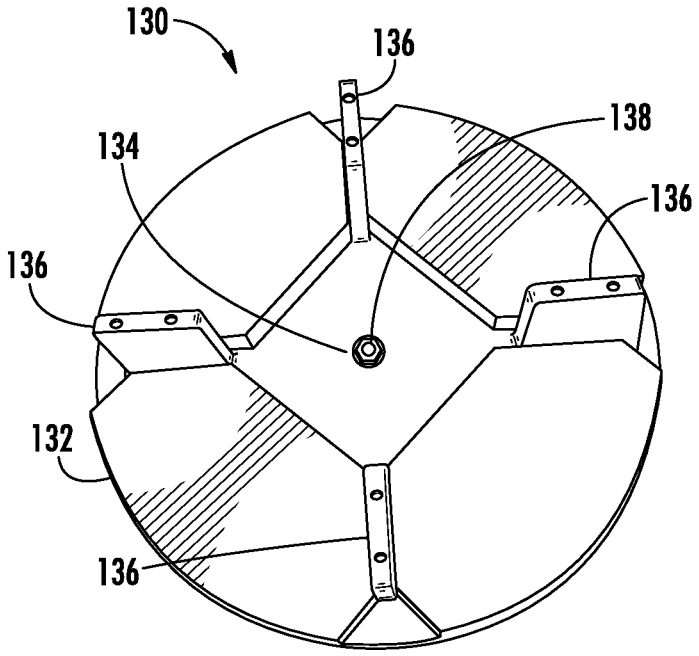
FIG. 4A and FIG. 4B illustrate a top view and a bottom view, respectively, of an example of a paver spacer of the presently disclosed paver lock down system.
Figure 4B:
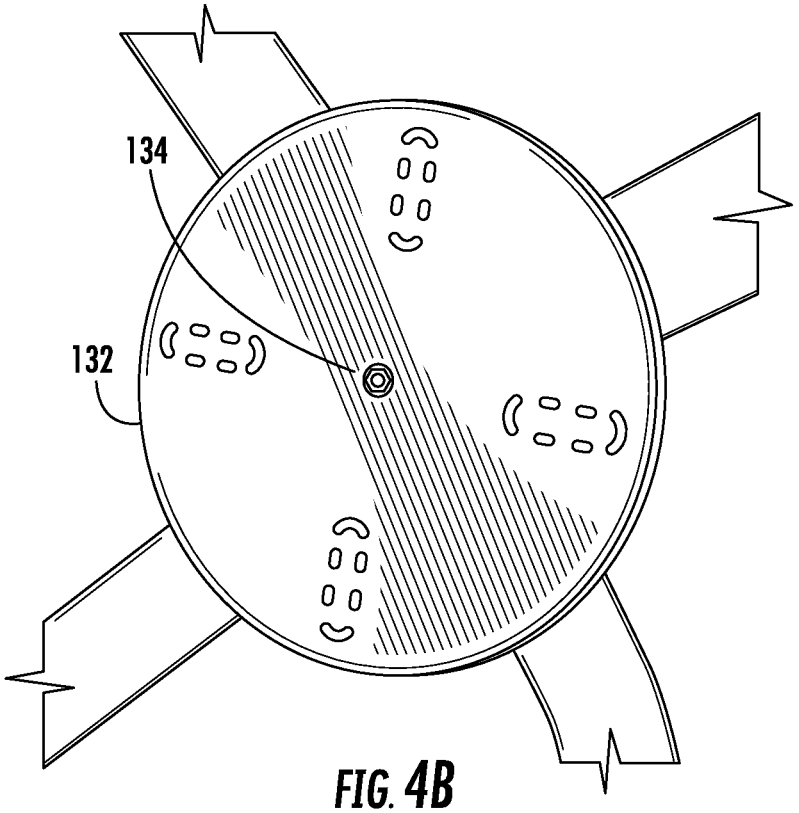

Referring now to FIG. 4A and FIG. 4B is a top view and a bottom view, respectively, of an example of the paver spacer 130 of the presently disclosed paver lock down system 100. In this example, the paver spacer 130 is circular. However, the paver spacer 130 can be any suitable shape, such as circular, rectangular, square, and the like. Further, in this example, the paver spacer 130 is formed of plastic. However, the paver spacer 130 can be formed any rigid strong material, such as plastic, aluminum, stainless steel, and the like.

The paver spacer 130 includes a baseplate 132. A threaded nut 134 may be provided at about the center of the baseplate 132, wherein the threaded nut 134 may be embedded into the baseplate 132. Protruding upward from the surface of the baseplate are four tabs 136, as shown in FIG. 4A. The four tabs 136 are provided for setting the corners of the pavers 112 in relation to each other. Further, the four tabs 136 are used to set the spacing between the pavers 112 (see FIG. 8). Additionally, the four tabs 136 are provided for guiding the straps 114 onto the paver spacer 130 (see FIG. 5A, FIG. 5B, FIG. 5C, and FIG. 5D). In one example, tabs 136 may be about ⅛ of inch thick and in another example may be about 3⁄16 of an inch thick, and are about ¾ of an inch high. The threaded nut 134 may be provided for fastening the ends of the straps 114 to the paver spacer 130 via, for example, a screw (see FIG. 6A and FIG. 6B). The paver spacer 130 may further include a recessed portion 138. Recessed portion 138 is preferably sized and shaped to allow the space required for the ends of straps 114, for example, the ends of four straps 114 from four adjacent pavers, to stack on each other without lifting the corners of the paver 112 up, which could possibly creating a tripping hazard, unwanted stress on the paver 112 corner(s). The recessed portion 138 may be, in one example, about 1 inch square and about ⅛ inch deep. The combination and configuration of the recess portion 138, the paver spacer 130, and notch 120, there is sufficient room to bring the paver straps 114 together to be secured with securing mechanism 139, such as screw 142, washer 140 and nut 134.

Figure 5A:
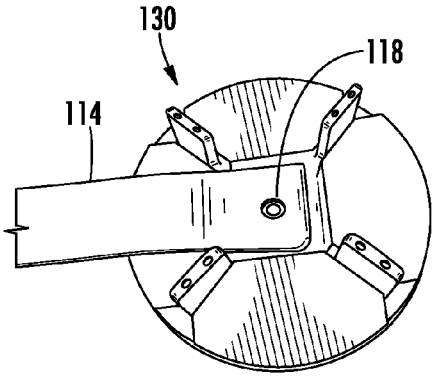
Figure 5B:
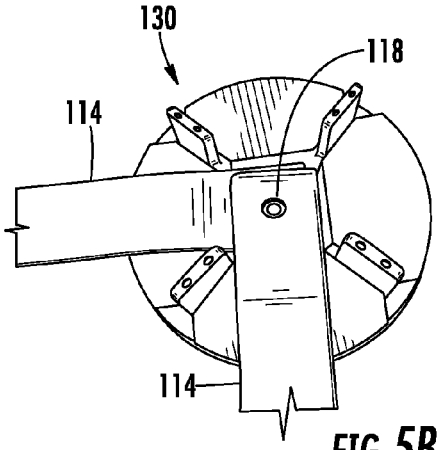
Figure 5C:
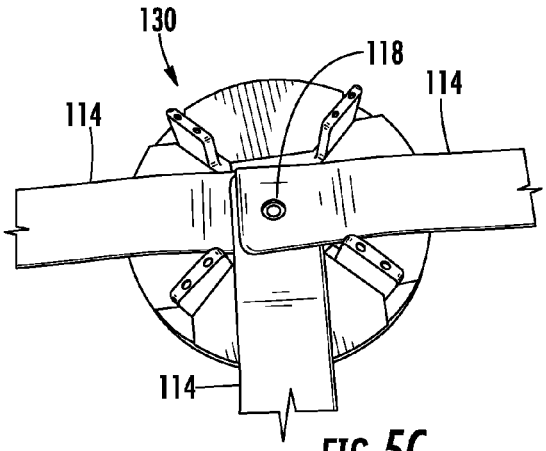
Figure 5D:
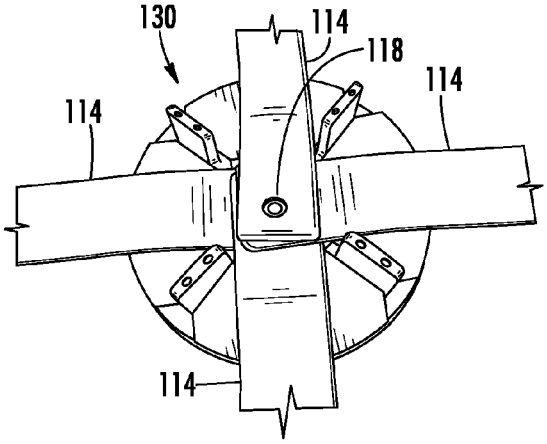

Referring now to FIG. 5A, FIG. 5B, FIG. 5C, and FIG. 5D are top views of the paver spacer 130 and a process of mating the straps 114 thereto (absent the paver 112). Namely, FIG. 5A shows the end of a first strap 114 aligned to the paver spacer 130 via one pair of tabs 136 and its hole 118 aligned with the threaded nut 134. FIG. 5B shows the end of a second strap 114 aligned to the paver spacer 130 via a different pair of tabs 136 and its hole 118 also aligned with the threaded nut 134. FIG. 5C shows the end of a first strap 114 aligned to the paver spacer 130 via a yet different pair of tabs 136 and its hole 118 also aligned with the threaded nut 134. FIG. 5D shows the end of a first strap 114 aligned to the paver spacer 130 via a still different pair of tabs 136 and its hole 118 also aligned with the threaded nut 134.

After the ends of the four straps 114 are positioned with respect to the paver spacer 130, FIG. 6A and FIG. 6B show a process of connecting the four straps 114 to the paver spacer 130 via a securing mechanism 139. Securing mechanism 139 may include one or more of washer 140, screw 142, threaded nut 134, and/or any other suitable mechanism for connecting the four straps 114 to the paver spacer 130. In one example, a washer 140 is placed atop the stack of four straps 114 at the holes 118, as shown in FIG. 6A. Next, for example, and as shown in FIG. 6B, a screw 142 is installed through the holes 118 in the four straps 114 and tightened into the threaded nut 134 (not visible).

Referring now to FIG. 7 is a plan view of an array of the paver assemblies 110 of the paver lock down system 100, wherein the paver assemblies 110 are connected together via the straps 114 to form a safety net. Connecting the straps 114 at each paver assembly 110 effectively ties all the paver assemblies 110 together, such that no paver assembly 110 can be moved or tampered with unless all lock down screws 142, for example, are removed for that paver assembly 110. FIG. 8 is a cross-sectional view of the joint between the paver assemblies 110 of the presently disclosed paver lock down system 100 and showing more details thereof. In particular, FIG. 8 shows a notch 120 at the underside of the corners of the pavers 112. The notch 120 is formed, for example, according to the step 315 of the method 300 of FIG. 3. FIG. 8 also shows an open joint 150 between the two paver assemblies 110. The open joint 150 allows access to the center of the paver spacer 130 for fastening the straps 114 thereto. Open Joint 150 is preferably created by tabs 136 of paver spacer 130, and in one example may be about ⅛ of inch wide, and in another example may be about 3⁄16 of an inch wide.

Certain pavers, for example porcelain pavers, are very light (thus subject to being tampered with) compared with the traditional 2-inch thick concrete pavers typically used for pedestal systems. Referring again to FIG. 1 through FIG. 8, the presently disclosed paver lock down system 100 provides a hidden lock down or tied down feature (i.e., the straps 114 fastening to the paver spacers 130) for a paver system 100. Namely, the paver 112 intersections of the paver lock down system 100 offer a unique locking mechanism that is hidden below the paver 112 surface and accessed through the open joint 150 that is created in all raised pedestal/floating paver systems. This locking mechanism prevents vandalism or tampering with the individual pavers. The locking mechanism also prevents the floating paver system from "creep" or "migration" across the edges of the installation.

Referring now to FIG. 9 is a flow diagram of an example of a method 900 of installing the presently disclosed paver lock down system 100. FIG. 1 and FIG. 10 through FIG. 24 will be referred to in the method 900. By way of example, the method 900 describes the installation of a 2×2 array of paver assemblies 110, such as the 2×2 array of paver assemblies 110 shown in FIG. 1. However, it is understood that the method 900 can be applied generally to any configuration and any number of paver assemblies 110. The method 900 may include, but is not limited to, the following steps.

At a step 910, the first paver assembly 110 and four paver spacers 130 are provided. Then, four paver spacers 130 are aligned to the four straps 114 at the four respective corners of the first paver assembly 110. This step is shown pictorially in FIG. 10 and FIG. 11.

At a step 915, the second paver assembly 110 is provided adjacent to the first paver assembly 110, wherein the two straps 114 at the two corners of the second paver assembly 110 are aligned to two of the existing paver spacers 130. This step is shown pictorially in FIG. 12 and FIG. 13.

At a step 920, two additional paver spacers 130 are provided. Then, a paver spacer 130 is aligned to each of the straps 114 at the two remaining corners of the second paver assembly 110. This step is shown pictorially in FIG. 13.

At a step 925, the third paver assembly 110 is provided adjacent to and below the second paver assembly 110, wherein the two straps 114 at the two corners of the third paver assembly 110 are aligned to two of the existing paver spacers 130. This step is shown pictorially in FIG. 14 and FIG. 15.

At a step 930, two additional paver spacers 130 are provided. Then, a paver spacer 130 is aligned to each of the straps 114 at the two remaining corners of the third paver assembly 110. This step is shown pictorially in FIG. 15.

At a step 935, the fourth paver assembly 110 is provided adjacent to the first and third paver assemblies 110. Then, the straps 114 at the three corners of the fourth paver assembly 110 are aligned to the existing paver spacers 130. This step is shown pictorially in FIG. 16, FIG. 17, and FIG. 18.

At a step 940, one additional paver spacer 130 is provided. Then, the paver spacer 130 is aligned to the strap 114 at the remaining corner of the fourth paver assembly 110. This step is shown pictorially in FIG. 1.

Figure 16:
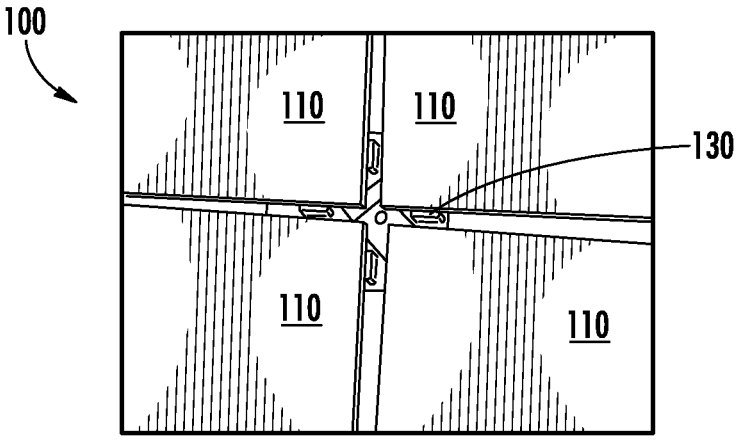
Figure 17:
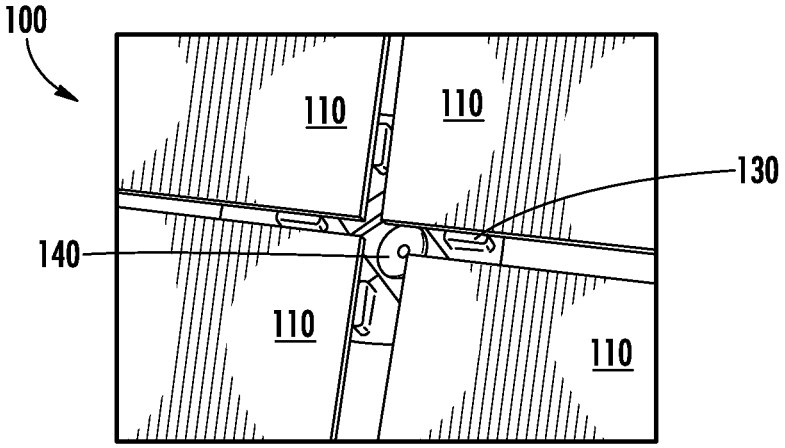
Figure 18:
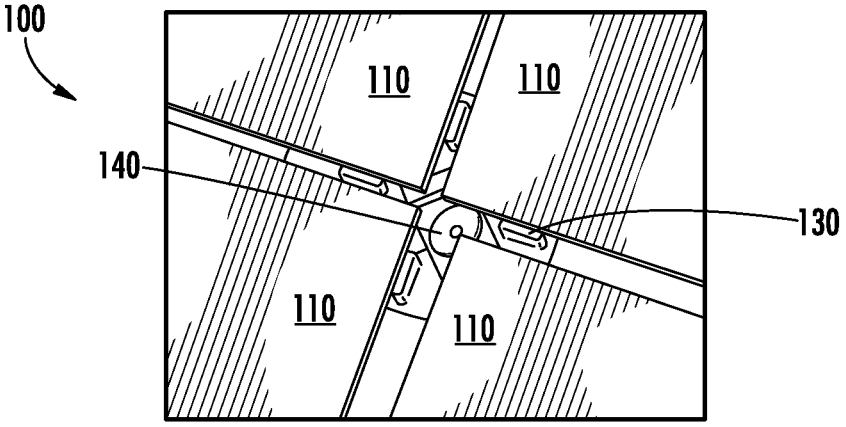
Figure 19:
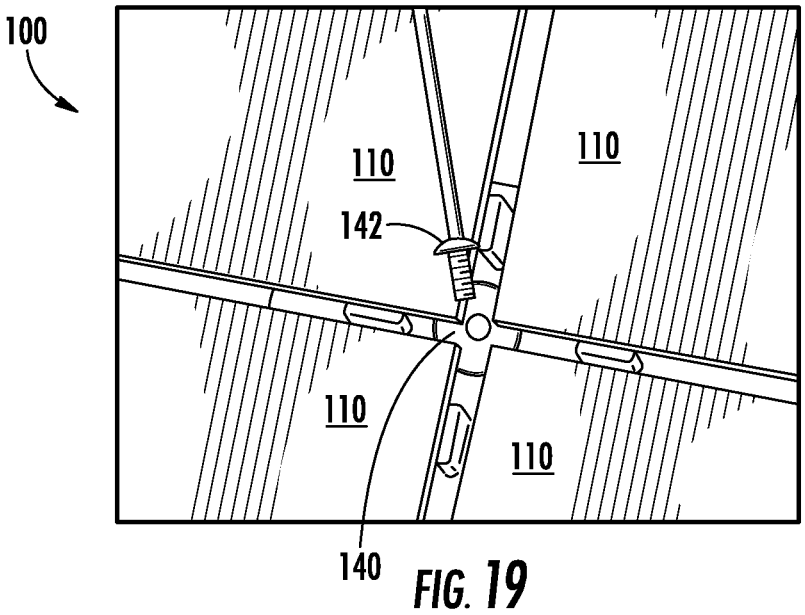
Figure 20:
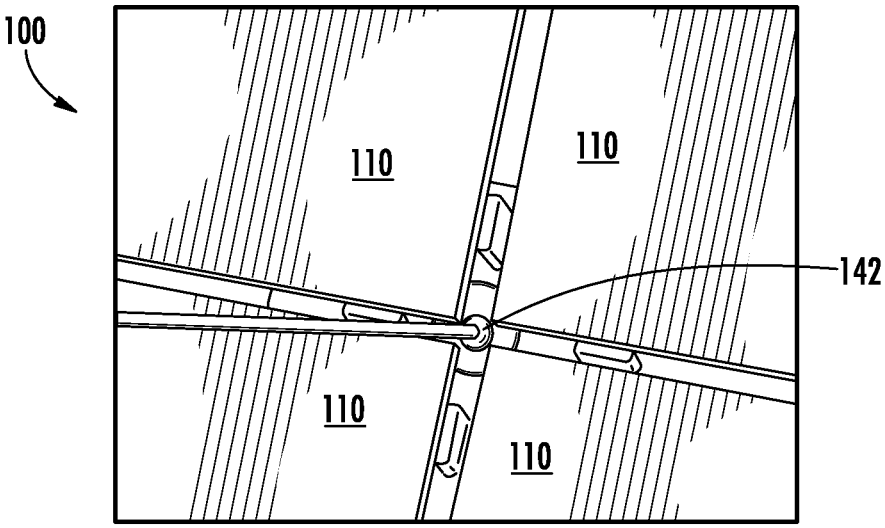
Figure 21:
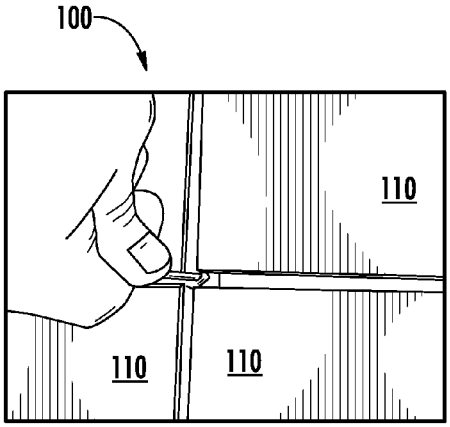
Figure 22:
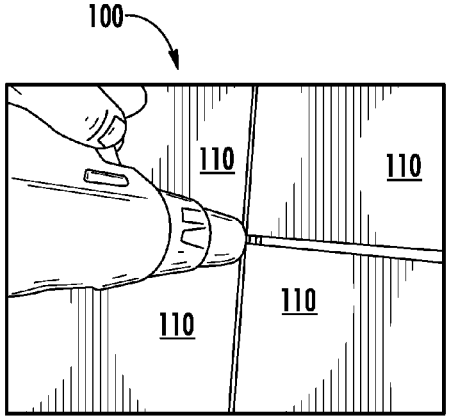
Figure 23:
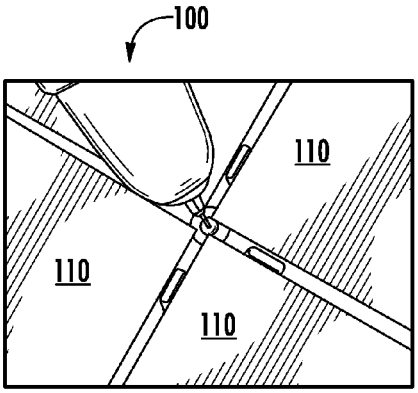
Figure 24:
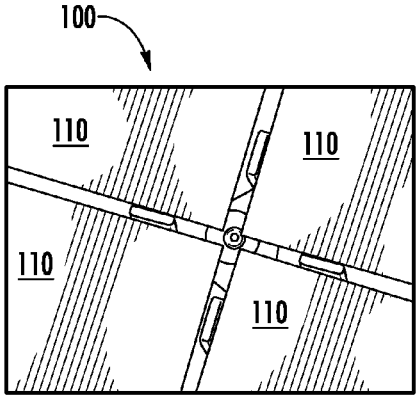

At a step 945, washer 140 and the screw 142 are installed at the paver spacer 130 at the intersection of the four paver assemblies 110. For example, FIG. 16 shows that the strap 114 of the fourth paver assembly 110 is pulled back slightly from the centermost paver spacer 130, which is the intersection of the four paver assemblies 110. FIG. 17 shows that this allows enough room to drop the washer 140 into place atop this strap 114. Then, FIG. 18 shows that, with the washer 140 in place, the fourth paver assembly 110 can be slid into place with respect to the centermost paver spacer 130. FIG. 19 shows the four paver assemblies 110 in place with respect to the centermost paver spacer 130 and with the washer 132 in place. Then, FIG. 20 shows the screw 142 being installed through the washer 132 and through the stack of four straps 114 at the centermost paver spacer 130. The screw 142 is tightened into the threaded nut 134 (not visible) in the centermost paver spacer 130. FIG. 21, FIG. 22, FIG. 23, and FIG. 24 show another sequence of the screw 142 being tightened into the threaded nut 134 in the centermost paver spacer 130.

Using the method 900, the complete field of paver assemblies 110 are tied together to form a paver safety net and tie down system, which has the effect of a large safety net under the paver system. The bonding layer 116 along with the embedded 1-inch nylon straps 114 in an X pattern within each paver assembly 110 add strength to the pavers 112 as well as holding any sharp shards and pieces suspended and together should a paver 112 happen to break from heavy weight or shocking impact. Accordingly, the presently disclosed paver lock down system 100 and methods 300, 900 provide a composite, reinforced backing system to any nearly any paver, such as a standard 2-cm thick (or any other thickness) porcelain pavers (any manufacturer).

Following long-standing patent law convention, the terms "a," "an," and "the" refer to "one or more" when used in this application. Thus, for example, reference to "a subject" includes a plurality of subjects, unless the context clearly is to the contrary (e.g., a plurality of subjects), and so forth.

Throughout this specification, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and figures, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the description herein.

What is claimed is:

1. A paver locking system, comprising:

a. a paver assembly, comprising:

i. a paver; and ii. straps attached to a back portion of the paver;

b. a paver spacer; and c. a securing mechanism for securing paver straps to the paver spacer.

2. The paver locking system of claim 1 wherein the straps attached to the back portion of the paver comprise a first strap and a second strap configured to form an X pattern on the back portion of the paver, wherein the first strap is arranged across a first diagonal and the second strap is arranged across a second diagonal of the back portion of the paver.

3. The paver locking system of claim 2 wherein each of the first strap and second strap are of a length such that each end of each of the first strap and second strap extend beyond its associated corner of the paver.

4. The paver locking system of claim 3 wherein the ends of the first strap and second strap extend about ⅝ of an inch beyond its associated corner of the paver.

5. The paver locking system of claim 1 further comprising a bonding layer disposed on the back portion of the paver and configured for securing the straps to the back portion of the paver, wherein the straps are secured between the bonding layer and back portion of the paver.

6. The paver locking system of claim 1 wherein the bonding layer comprises one of epoxy resin, fiberglass resin, or polyester resin.

7. The paver locking system of claim 1 wherein the bonding layer comprises a fiber mesh and an epoxy resin.

8. The paver locking system of claim 6 wherein the bonding layer covers substantially an entirety of the back portion of the paver.

9. The paver locking system of claim 1 wherein the paver comprises a porcelain paver about 2 cm thick.

10. The paver locking system of claim 1 wherein the straps further comprise a hole provided in each end of the straps.

11. The paver locking system of claim 1 wherein the paver spacer comprises:

a. a baseplate; and b. tabs protruding upward from a first surface of the base plate.

12. The paver locking system of claim 11 wherein the tabs are configured for one or more of setting corners of the paver in relation to another paver, to set the spacing between adjacent pavers, and to guide the straps onto the paver spacer.

13. The paver locking system of claim 11 wherein the tabs comprise four tabs equally spaced about the base plate.

14. The paver locking system of claim 1 wherein the securing mechanism for securing the paver straps to the paver spacer comprises one or more of a screw, bolt, and nut.

15. The paver locking system of claim 11 wherein the paver spacer further comprises a recessed region formed in a central portion of the first surface of the paver spacer.

16. A paver spacer, comprising:

a. a baseplate;

b. a recessed central portion in a first surface of the baseplate; and c. tabs protruding upward from the first surface of the base plate and spaced equally about the recessed central portion wherein the baseplate is configured to receive at least one strap and a fastener.

17. A paver assembly, comprising:

a. a paver; and b. straps attached to a back portion of the paver, wherein the straps comprise a first strap and a second strap configured to form an X pattern on the back portion of the paver, and wherein the first strap is arranged across a first diagonal and the second strap is arranged across a second diagonal of the back portion of the paver.

18. A method of forming a paver assembly, comprising:

a. providing a paver;

b. removing an amount of paver material from an underside surface of each corner of the paver to form a notch at each corner of the paver;

c. installing a first strap and a second strap to the underside surface of the paver in an X pattern, wherein the first strap is arranged across a first diagonal and the second strap is arranged across a second diagonal of the underside surface of the paver; and d. applying a bonding layer to the underside surface of the paver, wherein the first strap and second strap are disposed between the bonding layer and the underside surface of the paver.

19. The method of claim 18 wherein the bonding layer comprises a fiber mesh and an epoxy resin.

20. A method of installing a paver locking system, comprising:

a. providing a first paver assembly and a paver spacer, wherein the first paver assembly comprises:

i. a first paver; and ii. straps attached to a back portion of the first paver, wherein the straps are configured in an X pattern and comprise a portion that extends beyond one or more of corners of the first paver;

b. aligning the paver spacer with at least one of the straps of the first paver at a respective corner of the first paver, wherein a portion of at least one of the straps of the first paver assembly overlaps a central portion of the paver spacer;

c. providing a second paver assembly adjacent to the first paver assembly, wherein the second paver assembly comprises:

i. a second paver; and ii. straps attached to a back portion of the second paver, wherein the straps are configured in an X pattern and comprise a portion that extends beyond one or more corners of the second paver;

d. aligning at least one of the straps of the second paver assembly with the paver spacer, such that it overlaps with a portion of the at least one of the straps of the first paver assembly at a central portion of the paver spacer; and e. securing the aligned at least one strap of the first paver and at least one strap of the second paver to the paver spacer at a central portion of the paver spacer where the at least one strap of the first paver and second paver overlap.

* * * * *